United States Patent [19]

Stier

[11] Patent Number: 4,519,435

[45] Date of Patent: May 28, 1985

[54] SLATS FOR VERTICAL VENETIAN BLINDS

[76] Inventor: Kenneth Stier, 220-55 46th Ave., Bayside, N.Y. 11361

[21] Appl. No.: 636,829

[22] Filed: Aug. 1, 1984

[51] Int. Cl.[3] ..... E06B 9/36; E06B 9/386

[52] U.S. Cl. ..... 160/166 A; 160/236; 428/126; 428/190; 428/193; 428/194

[58] Field of Search ..... 428/126, 190, 193, 194; 160/236, 166 A

[56] References Cited

U.S. PATENT DOCUMENTS 2,091,012 8/1937 Pratt ..... 160/236

*Primary Examiner*—Alexander S. Thomas

*Attorney, Agent, or Firm*—Abelman Frayne Rezac & Schwab

[57] ABSTRACT

A vertical venetian blind construction has slats comprised of strips of textile material comprising a backing and facing, the edges of the facing being rearwardly inturned, and the edges of the backing being forwardly inturned, the backing and the facing being secured to each other by securing means that extend beyond the inturned edges of the backing, and which terminate within the confines of the inturned edges of said backing, the facing or backing optionally being transversely or longitudinally pleated and the folds of the pleats secured to the other of the facing and the backing, the facing and the backing optionally being heat formable and pinch pleated or embossed.

15 Claims, 6 Drawing Figures

SLATS FOR VERTICAL VENETIAN BLINDS

FIELD OF THE INVENTION

This invention relates to slats for venetian blinds in which the slats thereof are vertically oriented strips, the invention being specifically directed to the formation of the vertically oriented strips for such blinds.

BACKGROUND OF THE INVENTION

Venetian blinds are commonly known in which vertical slats or strips are hung from slider members carried by a generally horizontal track. Commonly, pull cords are provided for moving the sliders to a desired position longitudinally of the track, and, for rotating the hangers about vertical axes to adjust the angular position of the vertical strips relative to each other.

More commonly, the vertical strips are metal strips and are painted or otherwise surface finished, including the applique of fabric material to a frontal face of the strips to enhance the decorative appearance thereof. Also, commonly, the strips themselves are formed of a textile material that has been sized, coated, or otherwise stiffened, such as strips of canvas, plisse, decorative weave bulky materials, such as Haitian cotton, or, so-called wood or bamboo strip weaves.

With such textile materials, the need arises not only to stiffen the fabric sufficiently for it to retain a substantially planar form when the strips are hung, but also to bond the fibres of the warps to an extent sufficient to prevent fraying out at the longitudinal edges of the strips, and to prevent unravelling of the threads.

These latter problems can be overcome by edge binding of the strips, but, only at a relatively high cost in manufacturing, and, at an increase in bulk of the strips at the edges thereof. Further, such operations tend to produce stresses in the strips that cause the strips to twist helically when hung, thus destroying the uniform appearance of the blind when in use. These latter problems are of course eliminated in the event the textile fabric is appliqued to a metal strip. However, such an organization of materials results in the elimination of the perceived hand and texture of the fabric, and its ability to filter light. The strips are then opaque due to the presence of the metal underlay or substrate, and are entirely mechanical in their appearance. Rather than to applique fabric to the metal slats or strips, a more convenient and cost effective approach is to print the metal strips in a manner simulating the texture and pattern of fabric and to suitably emboss the metal strips.

THE INVENTIVE CONCEPT

According to the present invention, the various disadvantages discussed above are eliminated in their entirety, it being possible to provide slats or strips for a vertical venetian blind construction in which the vertical strips have the visually perceived and tactile qualities of fabric material, and, in which the light filtering ability of the fabric material is retained thus enhancing its liveliness in visual perception.

According to the present invention, the vertical strip members are comprised of a lamina of flexible textile fabric sheet material comprising a backing having forwardly and inwardly turned longitudinal edges, and a facing of a width greater than the width of the backing, and which has rearwardly and inwardly turned longitudinal edges. Bonding material is interposed between the backing and the facing, and extends at least partially over the inwardly turned edges of the backing and facing, and, terminates within the confines of the inwardly turned edges of the backing.

In this manner, a turned edge is provided at the longitudinal edges of the backing and facing, thus precluding fraying or unravelling of the threads of the fabric and eliminating the need for separate edging of the strips. The respective backing and facing can be of a relatively loose weave, thus enhancing the light filtering capability of the strips and eliminating any opaque look thereof. Further, the bonding of the backing and facing can be easily effected under controlled conditions and result in little residual stress being developed in the strips, and in turn, eliminate the tendency of the strips to twist and curl when in use. The bonding may be effected by applying a suitable bonding material in fluid or paste form to the backing, and suitably activating the bonding material by heat in the event that it is a thermo-setting material, or, by heating and drying in the event that the bonding material is a thermally or chemically activated one.

Preferably, the bonding is effected by way of an intermediate lamina of a scrim material, which either has been bonded by a heat activatable thermo-setting material, or, which has been coated on both faces with a suitable chemically activated material, the edge turning, coating, laminating, and bonding process being entirely compatible with continuous strip forming operatings on a continuous production run basis by use of any suitable apparatus, such as is well known in the art.

Instead of employing thermo-setting or chemically activated bonding materials, the bonding may be carried out by heat and pressure, radio frequency welding, or ultrasonic welding in the event that the backing and facing are formed from materials compatible to such operations.

Further advantages that accrue from the present invention and the ability of the strips to be formed on a continuous production basis, are that one of the facing and backing can be pleated or pinch pleated either transversely, obliquely, or longitudinally during the forming operation to provide an entirely unusual decorative appearance. Alternatively, if the facing and backing are comprised of heat formable material, then, the possibility exists of decoratively heat embossing the strips during the laminating operation. In this latter event, preferably an intermediate layer of a heat formable textile material is incorporated into the laminate that has greater weight and strength than the relatively delicate fabrics of the facing and backing. The intermediate layer thus serves to preserve the embossed formations, thus enabling the production of the strips of pinch pleated, striaed or corded form, or of any other desired decorative appearance, such as that of bamboo poles, wicker, grass-cloth or any other such formations, or, to simulate quilting, needle point, embroidery, or the like, or, by the use of suitable materials having "burn out" capabilities, lace and tapestry effects can be obtained.

The invention will now be described with reference to the accompanying drawings, which illustrate preferred embodiments of the invention, and, in which.

Figure 1:
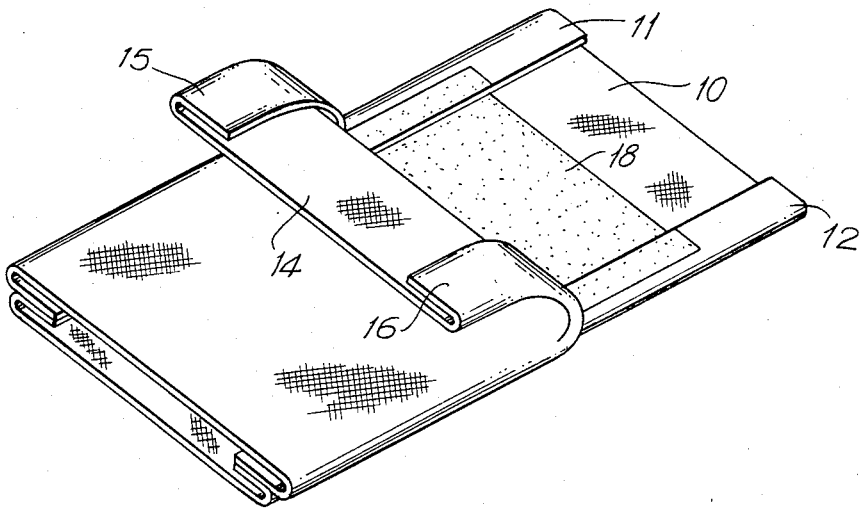
FIG. 1 is an exploded perspective view of one form of strip according to the present invention.

Referring to FIG. 1, the strip for use in a vertical venetian blind includes a backing 10 of fabric having longitudinal edges 11 and 12 which have been folded forwardly and then inturned for them to overlay on the rear face of the backing 10.

Overlaid on the backing 10 is a facing 14 of textile fabric material having longitudinal edges 15 and 16 that have been folded rearwardly and then turned inwardly for them to overlie the back face of the facing 14.

The backing and the facing may be of identical fabric and color, thus giving a tailored appearance or, they may be dissimilar in texture and color for a two tone reversible effect.

The width of the facing 14 is greater than the width of the backing 10, such that the edges of the facing 14 overlie and conceal the edges of the backing 10.

Applied to the inwardly facing surface of the backing 10 is a coating of an adhesive material, which can be applied to the backing 10 in any convenient manner, such as by means of a roller and doctor blade arrangement as is well known in the art, or, as illustrated in FIG. 1, the adhesive can be printed onto the inwardly facing surface of the backing in a lattice work 18 or any other suitable pattern. Optionally, the adhesive can be applied to the rear face of the facing. The adhesive 18 may be a heat activatable adhesive, or, it may be a heat drying or chemically activated adhesive.

Subsequent to the application of the adhesive 18, the facing is then appliqued to the adhesively coated backing 10, and, the composite structure is then rolled or ironed under heat and pressure to adhesively join the backing and facing to each other using any suitable apparatus as well known in the art.

Of particular importance to the laying down of the adhesive is that it be confined to the exposed rear face of the backing 10, and, that it extend over the edges of the inturned portions 11 and 12, and, that it terminate spaced from the fold lines of the inturned edge portions 11 and 12. In this way, it is insured that bleeding or seepage of the adhesive laterally of the backing can be eliminated, while at the same time providing a soft hand and feel to the edges of the backing, simulating that which would be obtained by a conventional stitching operation, but, without the cost disadvantages of such a stitching operation and the requirement that stitched lines appear on the facing.

In the finally assembled condition of the strip, the backing 10 and the facing 14 are adhesively attached to each other throughout the major width of the strip, thus providing body to the laminate, the fold lines of the respective inturned edges 11, 12, 15 and 16 remaining soft and pliable and devoid of harsh edges.

Figure 2:
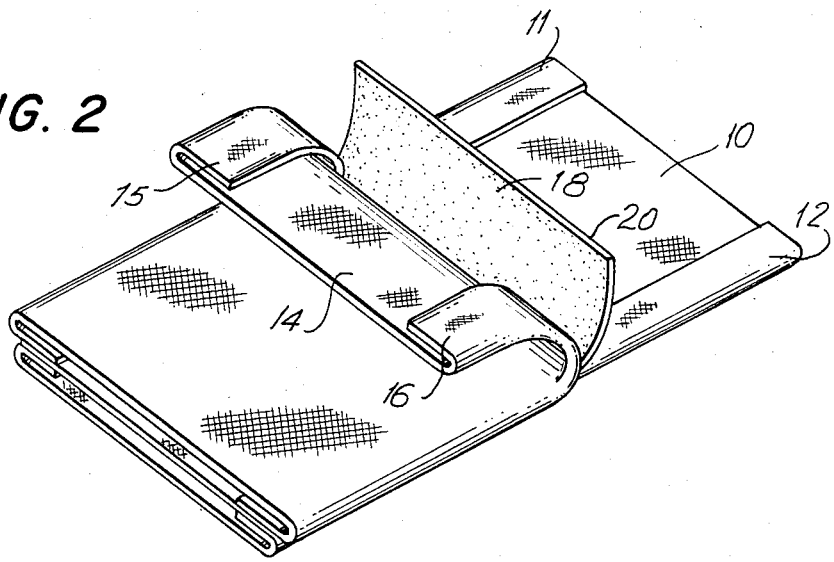
FIG. 2 is a view similar to FIG. 1, but showing a modification thereof.

Referring now to the embodiment of FIG. 2, the same reference numerals are used as those employed in the above description of FIG. 1. The major difference in the embodiment of FIG. 2 is that, rather than to apply the adhesive directly to the backing, or alternatively, to the rear face of the facing, a separate lamina 20 is interposed between the backing 10 and the facing 14.

Optionally, the intermediate lamina is a scrim of randomly oriented fibres that have been bonded to each other in order to develop the structural integrity of the scrim. The actual material employed in bonding the fibres of the scrim may itself provide the adhesive employed in securing the backing 10 and facing 14 to each other, for example, the bonding material can be a heat activated adhesive material that will become fluid on the application of heat at a temperature lower than that which would cause destruction of the fabric backing 10 and facing 14. Alternatively, the intermediate lamina 20 is coated or printed on both sides with a suitable adhesive 18, such as a heat activatable adhesive as described above with respect to FIG. 1.

The manner of assembling the strip of FIG. 2 is closely similar to that described above with respect to FIG. 1, the major difference involving the feeding of the activatable or adhesive coated intermediate lamina 20 into proper juxtaposition between the backing 10 and the facing 14. The intermediate lamina 20 is of a width sufficient for it to extend over the free edges of the inturned edges 11 and 12 of the backing 10, but is of lesser width than the distance between the fold lines of the inturned edges 11 and 12 for the intermediate strip 20 to terminate within those edges.

Figure 3:
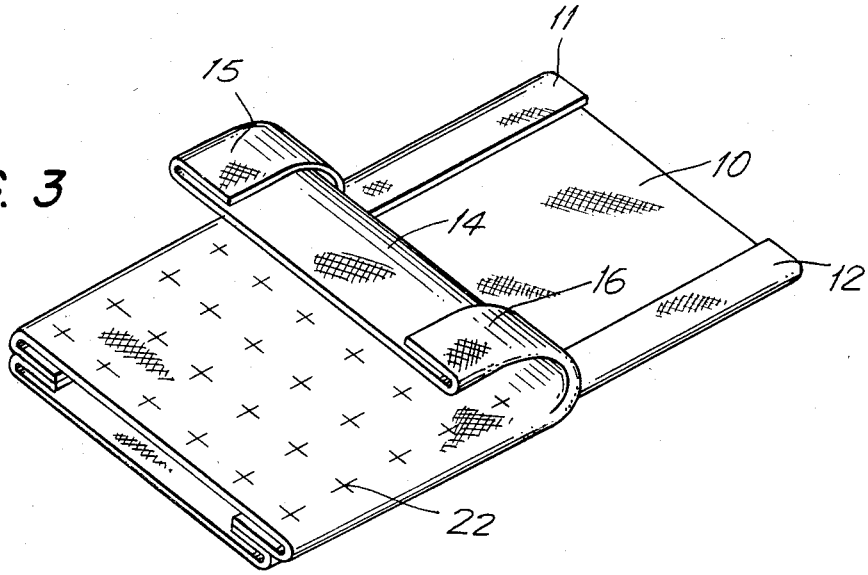
FIG. 3 is a view similar to FIG. 1, but showing a further modification thereof.

Referring now to FIG. 3, again the same reference numerals have been employed as were used in the description of FIG. 1. In FIG. 3, the backing 10 and the facing 14 are formed from fabric materials that are themselves capable of being adhesively activated, such as fabric materials woven from threads of polyamide, such materials being inherently capable of being welded to each other by heat welding, radio frequency welding, or ultrasonic welding techniques such as are well known in the art.

In the embodiment of FIG. 3, the backing 10 with its inturned edges 11 and 12 provides the underlay for the facing 14 with its rearwardly and inwardly turned edges 15 and 16, and the assembly is fed through a conventional apparatus in which the backing and facing are either face welded to each other, or, preferably are tack-welded as indicated at 22. In this manner, embroidery stitches or the like can be simulated enhancing the decorative appearance of the assembled strip.

Figure 4:
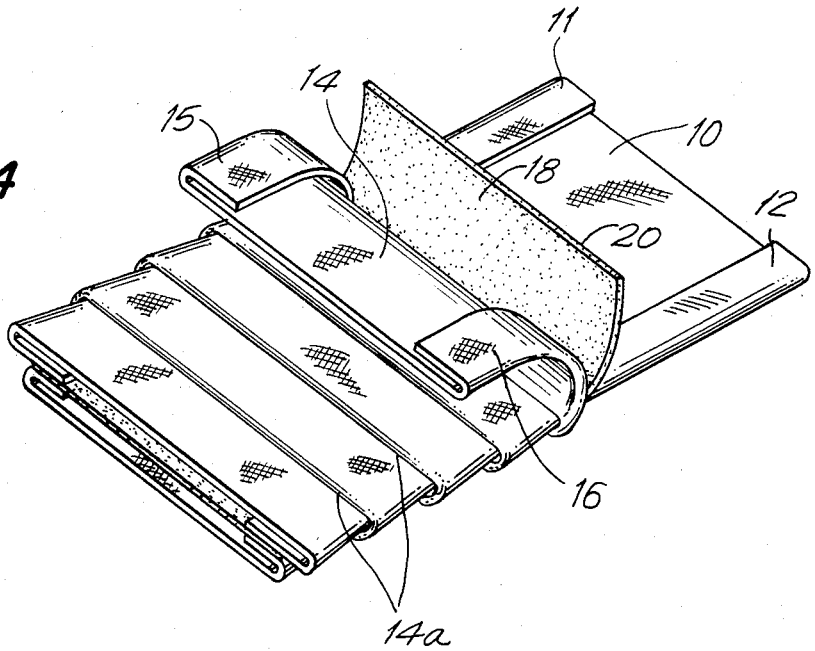
FIG. 4 is again a view similar to FIG. 1 and showing an alternative embodiment.

Referring now to FIG. 4, the same reference numerals again have beem employed as those employed in the description of FIG. 1. The embodiment of FIG. 4 proceeds directly from the embodiment described above with respect to FIG. 2, the major different in the FIG. 4 embodiment being that in the feeding of the facing 14, the facing is transversely pleated as indicated at 14*a*, any conventional pleating apparatus being employed for this purpose. Alternatively, and if desired, the facing 14 may be longitudinally pleated instead of being pleated in a direction transverse thereof or, can be pleated in oblique directions at any intermediate angle.

Subsequent to the assembly of the laminate with its pleated facing, the laminate is then processed through a conventional apparatus to heat set or otherwise provide for the bonding of the backing and facing to each other, during which process the inner folds of the pleats will become adhesively bonded to the intermediate strip 20, thus precluding movement of the pleats out of their assembled position.

Figure 5:
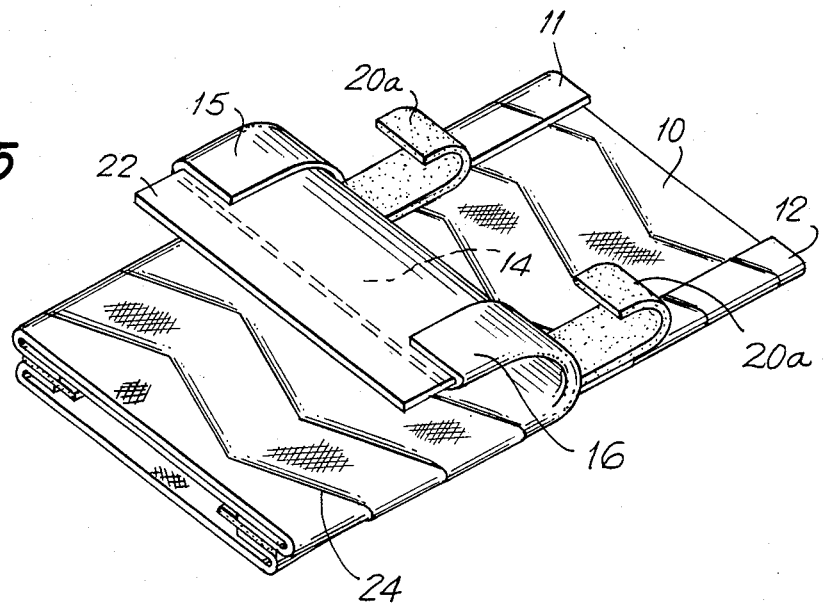
FIG. 5 is again a view similar to FIG. 1, and showing a further alternative embodiment; and, FIG. 6 is a rear view of FIG. 5.

Referring now to FIG. 5, again, the same reference numerals have beem employed to identify those members in common with FIG. 1. in FIG. 5, provision is made for the bonding of the inwardly turned edges 11 and 12 to the inwardly turned edges 15 and 16 by the use of separate strips 20*a* that are either adhesively activatable, or, that have been coated with an adhesive. As in the other embodiments, the strips 20*a* are so laid down on the edges 11 and 12 that they are spaced inwardly of the fold lines of the edges 11 and 12 and are concealed within the finished laminate. The major difference in the embodiment of FIG. 5 is the incorporation into the laminate of a heat formable strip 22 having a width sufficient for it to extend completely across the inwardly presented face of the facing 14, the edges of the heat formable strip 22 lying closely within, or actually forming the fold lines of the edges 15 and 16.

After assembly of the laminate, the laminate is then processed through conventional head embossing apparatus, which itself may constitute the apparatus used in the bonding step, to join the backing and the facing to the heat formable strip 22, and in which the laminate becomes embossed to simulate, for example, pinch pleating, quilting, or the like. Optionally, the embossing apparatus may simulate stitches to further enhance the simulation of quilting.

During the laminating and embossing process, the edges of the backing and the edges of the facing become bonded to each other. Optionally, the heat formable strip 22 also may be pre-coated with a suitable adhesive in order to produce bonding of the backing and the facing to the heat formable strip 22, or, the backing and facing may be of a heat formable material producing bonding of the backing and facing to the intermediate heat formable strip at the locations of the embossments.

Figure 6:
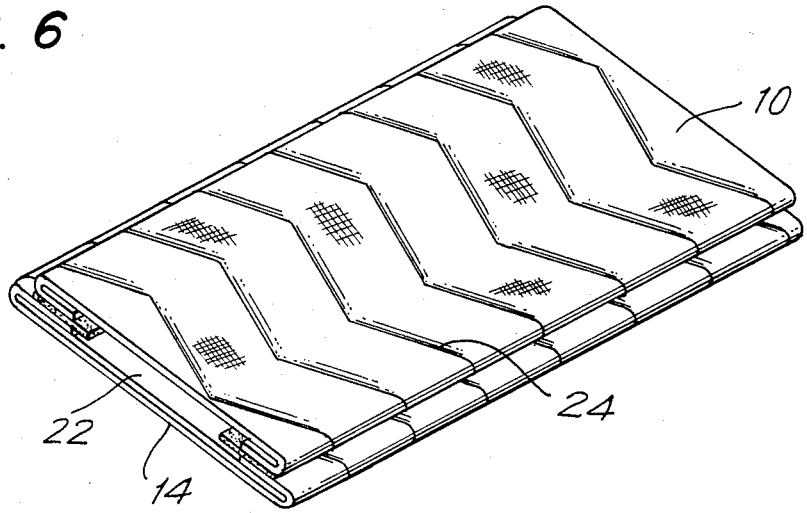

As is illustrated in FIG. 6, by reason of the pinch pleating of the facing of the strip, the backing also will become pinch pleated in reverse relief, i.e. the a verso impression of the facing.

Clearly, a multitude of alternative forms of embossments, pleating, pinch pleating, or surface treatments will readily present themselves to persons skilled in the art, including cross-stitching, loop-stitching and the like. Further, the intermediate heat formable strip 22 may be of a high bulk material in order to provide a soft padding to the finished strip, further enhancing the appearance of quilting, and enhancing the sound absorption capabilities of the finished strips.

It will be understood that the embodiments described above are preferred embodiments falling within the scope of the present invention, and are not to be considered as being limitative to the scope of the appended claims.

What is claimed

1. In a vertical blind construction comprised by:

an upper generally horizontal track;

slider members positioned within said track and moveable longitudinally thereof;

hanger members attached to said slider members; and, vertical strip members attached to the respective hanger members;

the improvement comprising:

selected ones of said strip members being comprised of a laminate of a flexible textile fabric sheet material and including;

a backing of a flexible textile sheet material of one width having forwardly and inwardly inturned longitudinal edges;

a facing of a flexible textile material of a width greater than the width of said backing, and having rearwardly and inwardly inturned longitudinal edges; and, securing means interposed between said backing and said facing and extending at least partially over said inturned edgings of said backing, said securing means terminating within the confines of said inturned edges of said backing.

2. The vertical blind construction of claim 1, in which said securing means is bonding material applied directly to at least one of said backing or facing and which extends over said backing and over at least a portion of said forwardly and inwardly inturned edges thereof.

3. The vertical blind construction of claim 2, in which said bonding material is a heat activatalbe thermosetting material.

4. The vertical blind construction of claim 2, in which said bonding material is a chemically activated bonding material.

5. The vertical blind construction of claim 1, in which said securing means is bonding material applied to an intermediate lamina of fabric material of a width greater than the distance between the longitudinal edges of said forwardly and inwardly inturned edges of said backing, and terminates within the confines of said forwardly and inwardly inturned edges of said backing.

6. The vertical blind construction of claim 5, in which said intermediate lamina is a tissue of scrim material having randomly oriented fibres, and a bonding material permanently bonding the fibres to each other.

7. The vertical blind construction of claim 6, in which said permanent bonding material is a heat activatable thermosetting material, and itself comprises said material for bonding said facing and backing to each other.

8. The vertical blind construction of claim 6, in which said bonding material is a heat activated thermosetting material applied to said scrim.

9. The vertical blind construction of claim 6, in which said bonding material is a chemically activatable material applied to said scrim.

10. The vertical blind construction of claim 1, in which said facing and backing are comprised of heat weldable materials, and said securing means is comprised by heat welded attachments of said facing and backing to each other.

11. The vertical blind construction of claim 1, in which said facing and backing are comprised of sonically weldable materials, and said securing means is comprised by ultrasonically welded attachments of said facing and backing to each other.

12. The vertical blind construction of claim 1, in which at least one of said facing and backing is pleated, individual pleats of said facing and backing being secured to the other of said facing and backing by said securing means.

13. The vertical blind construction of claim 1, in which said securing means includes an intermediate layer of a heat formable material, and said facing and backing are secured to said intermediate layer within heat formed embossments in said intermediate layer.

14. The vertical blind construction of claim 13, in which said intermediate layer is additional to said securing means and extends internally of said facing between the fold lines of said rearwardly and inwardly inturned edges of said facing.

15. A slat for a vertical blind construction comprised by:

a laminate of a flexible textile fabric sheet material and including:

a backing of a flexible textile sheet material of one width having forwardly and inwardly inturned longitidinal edges;

a facing of a flexible textile material of a width greater than the width of said backing, and having rearwardly and inwardly inturned longitudinal edges; and, securing means interposed between said backing and said facing and extending at least partially over said inturned edges of said backing, said securing means terminating within the confines of said inturned edges of said backing.

* * * * *